US009755334B2

(12) United States Patent
Li et al.

(10) Patent No.: US 9,755,334 B2
(45) Date of Patent: Sep. 5, 2017

(54) RETENTION MECHANISM FOR SHIELDED FLEX CABLE TO IMPROVE EMI/RFI FOR HIGH SPEED SIGNALING

(71) Applicant: Intel Corporation, Santa Clara, CA (US)

(72) Inventors: Xiang Li, Portland, OR (US); Yun Ling, Portland, OR (US); Chung-Hao J. Chen, Portland, OR (US); Hao-Han Hsu, Portland, OR (US); Shyamjith Mohan, Hillsboro, OR (US); Kuan-Yu Chen, Hillsboro, OR (US)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 14/750,875

(22) Filed: Jun. 25, 2015

(65) Prior Publication Data

US 2016/0380370 A1 Dec. 29, 2016

(51) Int. Cl.

| | |
|---|---|
| ***H01R 12/00*** | (2006.01) |
| ***H01R 12/70*** | (2011.01) |
| ***H01R 13/6585*** | (2011.01) |
| ***H01R 12/79*** | (2011.01) |
| ***H01R 13/6592*** | (2011.01) |
| *H01R 12/77* | (2011.01) |

(Continued)

(52) U.S. Cl.

CPC ..... *H01R 12/7076* (2013.01); *H01R 12/7011* (2013.01); *H01R 12/774* (2013.01); *H01R 12/79* (2013.01); *H01R 13/6585* (2013.01); *H01R 13/6592* (2013.01); *H01R 12/594* (2013.01); *H01R 12/775* (2013.01); *H01R 12/88* (2013.01)

(58) Field of Classification Search

None

See application file for complete search history.

(56) References Cited

U.S. PATENT DOCUMENTS

| | | | | |
|---|---|---|---|---|
| 5,184,965 A | | 2/1993 | Myschik et al. | |
| 5,871,362 A | * | 2/1999 | Campbell | H01R 12/7047 439/67 |

(Continued)

FOREIGN PATENT DOCUMENTS

| | | |
|---|---|---|
| KR | 2020090010291 | 10/2009 |
| KR | 200460172 | 4/2012 |

OTHER PUBLICATIONS

Notification of Transmittal of the International Search Report and the Written Opinion of the International Searching Authority issued for International Patent Application No. PCT/US2016/033968, dated Aug. 19, 2016.

*Primary Examiner* — Tho D Ta

(74) *Attorney, Agent, or Firm* — Blakely Sokoloff Taylor and Zafman LLP

(57) ABSTRACT

A retention apparatus for a shielded cable is described. In one embodiment, the apparatus comprises a substrate having a ground; a connector coupled to the substrate; a cable shielded with a conductive material and having an end connectable to the connector to electrically connect with the connector; an electrically conductive material coupled to the ground of the substrate; and a grounding retention mechanism to cause the electrically conductive material to electrically connect the cable to the ground of the substrate by applying a force to the cable shield.

17 Claims, 7 Drawing Sheets

(51) Int. Cl.
*H01R 12/59* (2011.01)
*H01R 12/88* (2011.01)

(56) References Cited

U.S. PATENT DOCUMENTS

| | | | | |
|---|---|---|---|---|
| 6,822,466 | B1 * | 11/2004 | Holcombe | G01R 1/0416 324/750.25 |
| 8,083,542 | B2 * | 12/2011 | Kodaira | H01R 12/594 439/497 |
| 8,628,349 | B2 * | 1/2014 | Kim | H01R 12/79 439/497 |
| 2008/0045076 | A1 * | 2/2008 | Dittmann | H01R 23/661 439/495 |
| 2010/0041273 | A1 | 2/2010 | Scherer et al. | |
| 2013/0344740 | A1 | 12/2013 | Figie | |
| 2014/0051291 | A1 * | 2/2014 | Safir | H01R 12/67 439/607.35 |

* cited by examiner

RETENTION MECHANISM FOR SHIELDED FLEX CABLE TO IMPROVE EMI/RFI FOR HIGH SPEED SIGNALING

FIELD OF THE INVENTION

Embodiments of the present invention relate to the field of high speed signaling in computing systems; more particularly, embodiments of the present invention relate to controlling electromagnetic interference (EMI) and/or radio-frequency interference (RFI) for internal cables of computing systems.

BACKGROUND OF THE INVENTION

Electromagnetic interference (EMI) or radio-frequency interference (RFI) are issues for internal cables of computing systems, such as desktops, All-in-Ones (AIOs), notebooks, tablets and smart phones. Because of this, shielded cables are recommended for use as internal cables for these computing systems. There are a number of shielded cables that are commonly used, including, for example, shielded u-coax cables, shielded flexible printed circuit (FPC) cables and shielded flexible flat cable (FFC) cables.

One solution to reduce EMI and RFI for the internal cables has been developed at Intel Corporation of Santa Clara, Calif. They developed a grounding mechanism that achieves low EMI/RFI by using a conductive material to attach a cable shield to a ground pad on printed circuit board (PCB) when the cable is connected to a connector attached to the PCB. In such cases grounding the shield properly can provide ~20 dB noise reduction at ~2.4 GHz in comparison to the case of floating shield.

One problem associated with the use of conductive tape in this EMI/RFI grounding mechanism is that once the cable is installed, it becomes very difficult to remove the cable. Therefore, rework is very challenging, and damage to the connector often occurs when peeling off the tape. As a result, although the RFI mitigation characteristics are good, the use of this approach is not expected to be prevalent.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Interconnection schemes and method for using the same are described herein. The interconnection schemes including several grounding retention mechanisms. In one embodiment, these retention mechanisms can be rework-friendly with still reliable electrical connection between cable shield and substrate (e.g., printed circuit board (PCB)) ground that ensures low EMI/RFI.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

In one embodiment, the interconnect scheme disclosed herein includes the substrate (e.g., printed circuit board (PCB), having a first node (e.g., a ground node) (e.g., an exposed ground pad, a voltage reference node)), a connector that is coupled or otherwise attached to the substrate, a cable shielded with a conductive material and having an end that is attachable (e.g., insertable) to the connector to electrically connect the cable to the connector, an electrically conductive material coupled to the substrate ground, and a grounding retention mechanism to cause the electrically conductive material to electrically connect the cable to the ground of the substrate by applying a force to the cable shield.

In one embodiment, the grounding retention mechanism comprises a retention actuator. In one embodiment, the retention actuator is coupled to the connector to apply a retention force onto the shield of the cable when it is in a first position after the cable has been electrically connected to the connector. In one embodiment, the electrically conductive material is compressible and the retention force causes compression of the electrically connected material between the cable and the substrate of the material when the force is applied on the shield.

In one embodiment, EMI/RFI grounding retention mechanism is integrated into the actuator of the connector (e.g., a FPC/FFC connector). In such a case, the actuator that secures cable also applies a retention force to the cable shield with sufficient force to compress an electrical conductive material placed in between the shield and substrate (PCB) ground the cable shield. Therefore, the cable shield makes good electrical contact to substrate (e.g., PCB) ground.

Figure 1A:
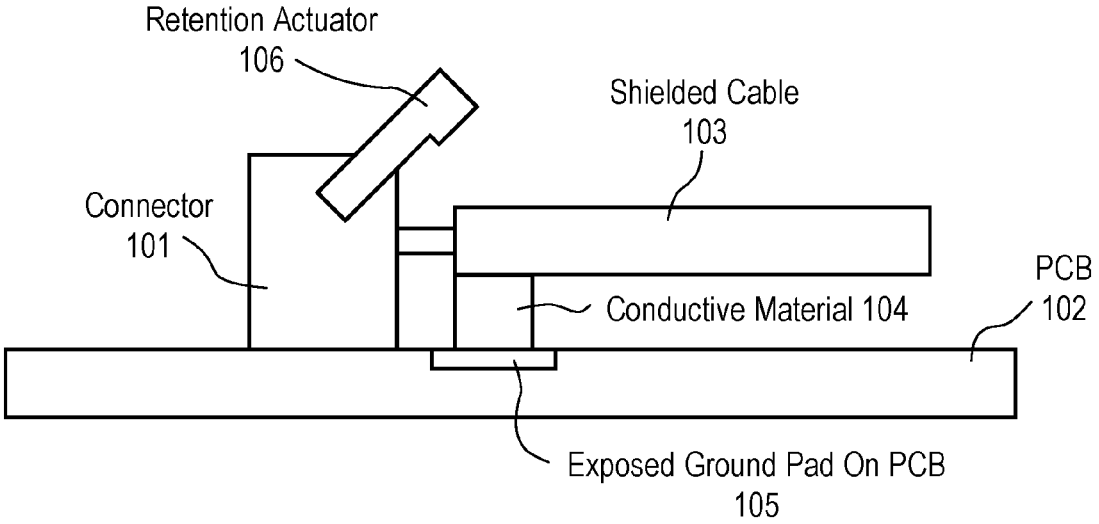
FIGS. 1A and 1B illustrate an integrated EMI/RFI grounding retention mechanism that includes an actuator.
Figure 1B:
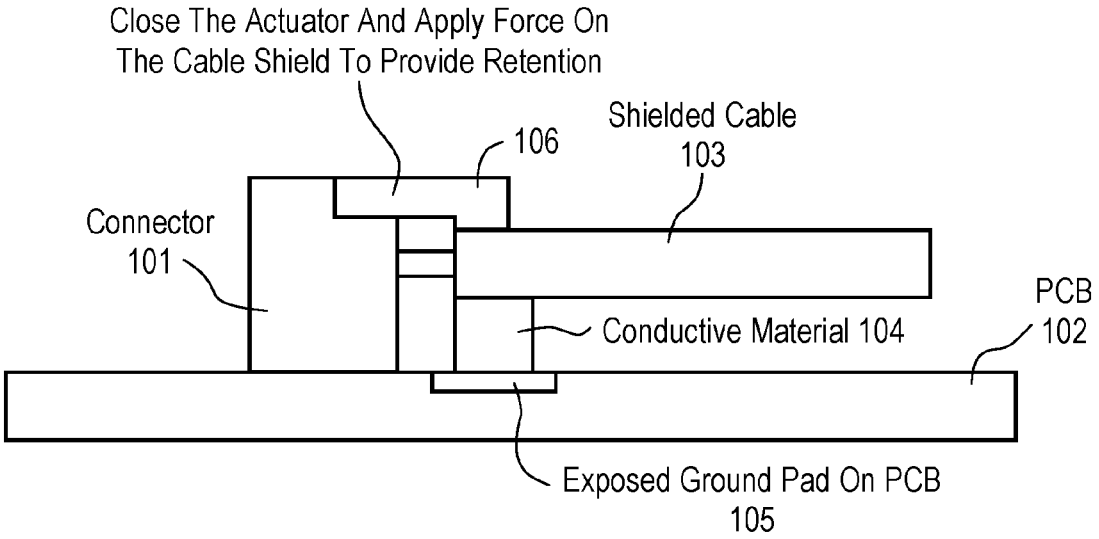

FIGS. 1A and 1B illustrate an integrated EMI/RFI grounding retention mechanism that includes and actuator. In one embodiment, the actuator is connected to the connector. Referring to FIG. 1A, connector 101 (e.g., flexible flat cable (FFC), flexible printed circuit (FPC) connector, etc.) is coupled to a substrate, printed circuit board (PCB) 102. Shielded cable 103 is then electrically connected to connector 101. A conductive material 104 electrically connects shielded cable 103 to exposed ground pad 105, which is on PCB 102. In one embodiment, electrically conductive material 104 comprises an EMI gasket, direct metal (e.g., steel), solder, or other material that is compressible and electrically conductive. Also connected to connector 101 is a retention actuator 106. In FIG. 1A, retention actuator 106 is in an open position.

FIG. 1B illustrates actuator 106 in a closed position. In the closed position, actuator 106 contacts shielded cable 103 and applies a force on shielded cable 103 to provide retention. The force on shielded cable 103 makes an electrical connection between shielded cable 103 and exposed ground pad 105 via conductive material 104. In one embodiment, actuator 106 applies the force in response to manually moving actuator 106.

Figure 2A:
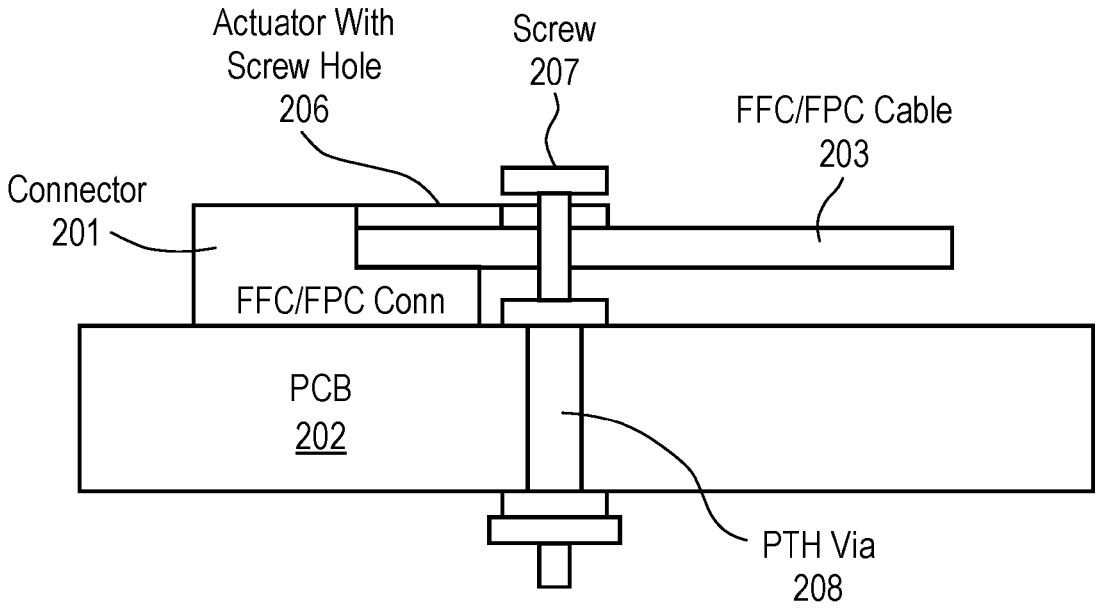
FIGS. 2A and 2B illustrate an example of an integrated screw-type actuator for EMI/RFI grounding.
Figure 2B:
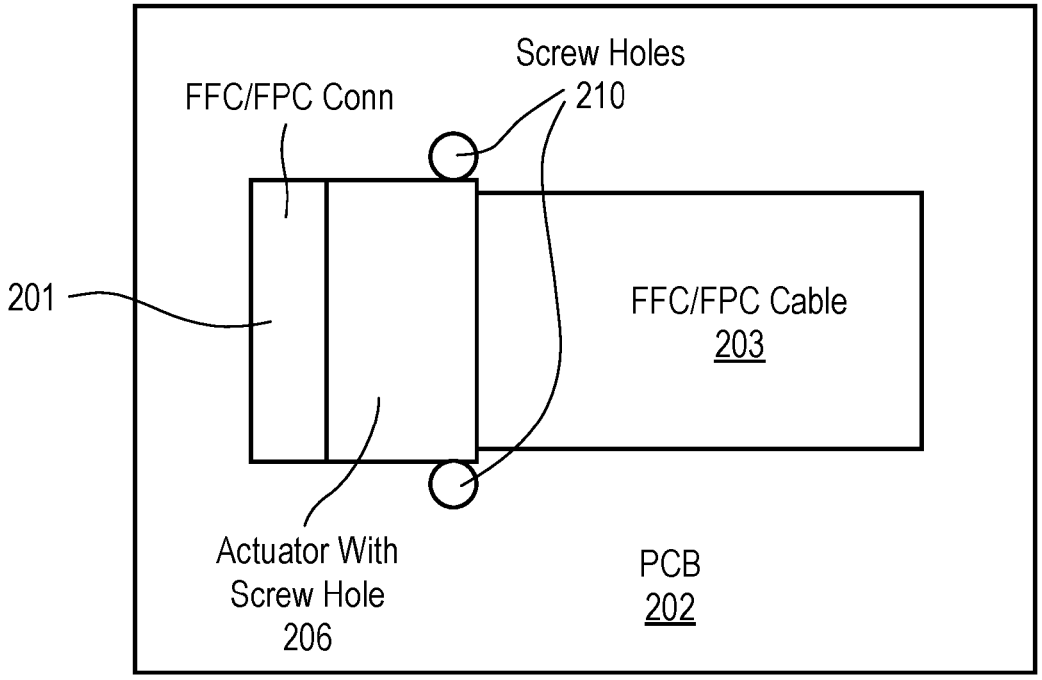

In another embodiment, the grounding retention mechanism comprises a screw-type actuator. In such a case, the screw-type actuator includes one or more screw holes. FIGS. 2A and 2B illustrate an example of an integrated screw-type actuator for EMI/RFI grounding.

Referring to FIG. 2A, a connector 201 is attached to PCB 202 (or other substrate). PCB 202 includes a plated-through hole (PTH) (a voltage reference node (e.g., ground)) via 208. Cable 203 (e.g., a FFC/FPC cable) electrically connects with connector 201. An actuator with a screw hole 206 is positioned on top of cable 203. Screw 207 is attached to PTH via 208, thereby securing actuator 206 to apply a force to cable 203 by tightening screw 207. While not shown in FIG. 2A or 2B, a conductive material is between cable 203 and an exposed ground pad on PCB 202 such that when actuator 206 is secured in place by screw 207, an electrical connection occurs between shielded cable 203 and the exposed ground pad on PCB 202 via this conductive material.

FIG. 2B illustrates the top view of the PCB (or other substrate). Referring to FIG. 2B, two screw holes 210 are shown on opposite sides of actuator 206. Screws 207 are attached via screw holes 210 to secure actuator 206 in place so that actuator 206 applies a force on to shielded cable 203.

In another embodiment, the grounding retention mechanism comprises an integrated latch-type actuator for EMI/RFI grounding. Such a latch-type actuator includes a latch that latches to a substrate when a latch is in a particular position. The latch-type actuator may comprise a fork, a hook, or an eye-of-needle (EON) as part of the latch.

Figure 3A:
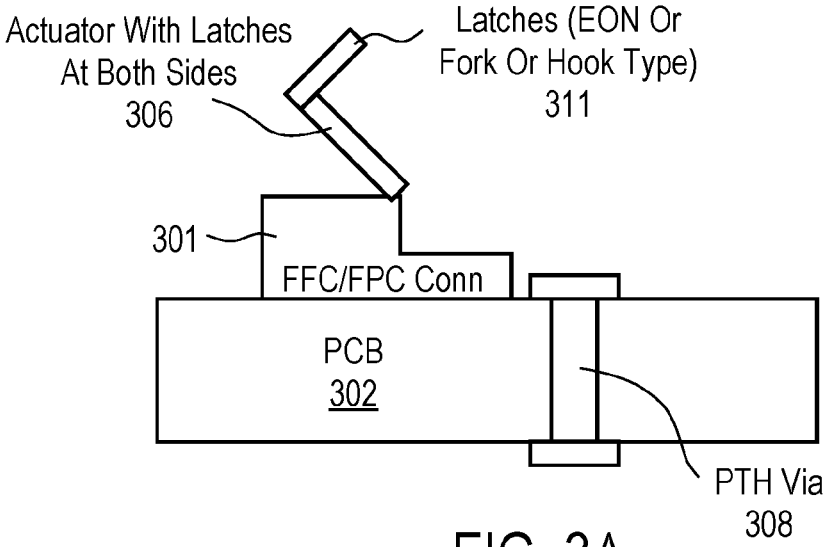
FIGS. 3A-3C illustrate examples of an integrated latch-type actuator.
Figure 3B:
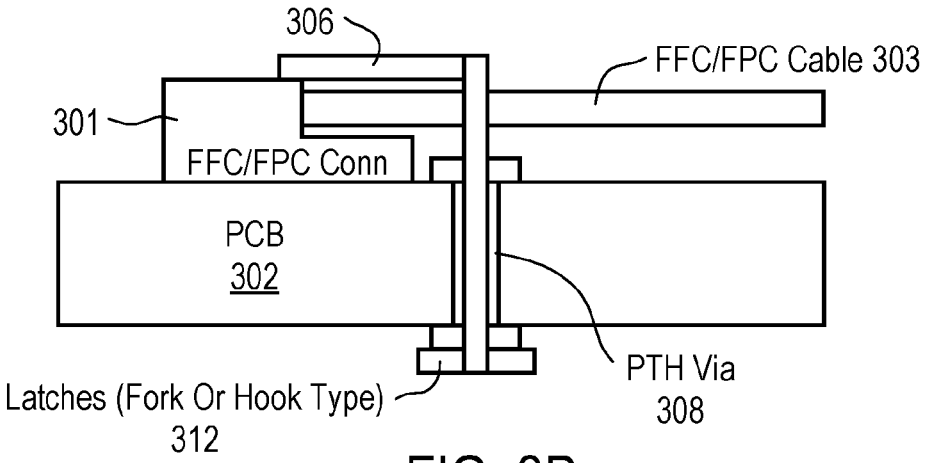
Figure 3C:
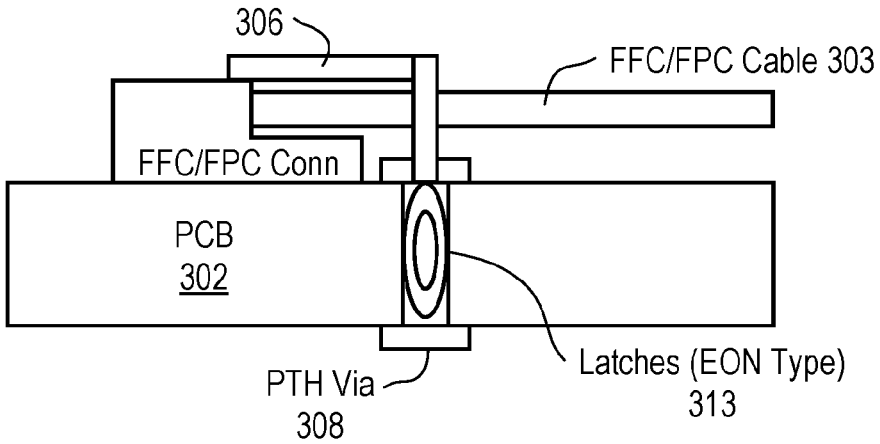

FIGS. 3A-3C illustrate examples of an integrated latch-type actuator. Referring to FIG. 3A, connector 301 is attached to PCB (substrate) 302. PCB 302 includes one or more of PTH vias 308. Actuator 306 includes a latch on both sides. More specifically, latch 306 includes latches 311 (e.g., EON, fork, or hook-type). That is, there are two latches at the ends of the actuators. Therefore, the actuator can apply force more evenly to the cable. In FIG. 3A, the actuator is in the open position.

FIG. 3B illustrates a fork- or hook-type latch in the closed position. In the closed position, latches 312 (e.g., fork-type latch, hook-type latch, etc.) are inserted and electrically connect to PTH vias 308. Actuator 306 is in electrical contact with shielded cable 303 (e.g., FFC/FPC cable). Latch 306 is in electrical contact with shielded cable 303 which is grounded to the connection of actuator 306 with PTH via 308.

FIG. 3C illustrates a closed position of an actuator with a latch that includes an EON-type latch 313. In the closed position, actuator 306 is in electrical contact with shielded cable 303 and is electrically coupled with the ground (a voltage reference node) via PTH via 308.

In one embodiment, the grounding retention mechanism comprises a lever-type or similar retention mechanism. When the lever is locked, it applies pressure to the cable and cable shield to achieve a good grounding connection to the PCB ground. The lever type retention mechanism can be a component separate from the connector or can be integrated as part of the connector.

Figure 4B:
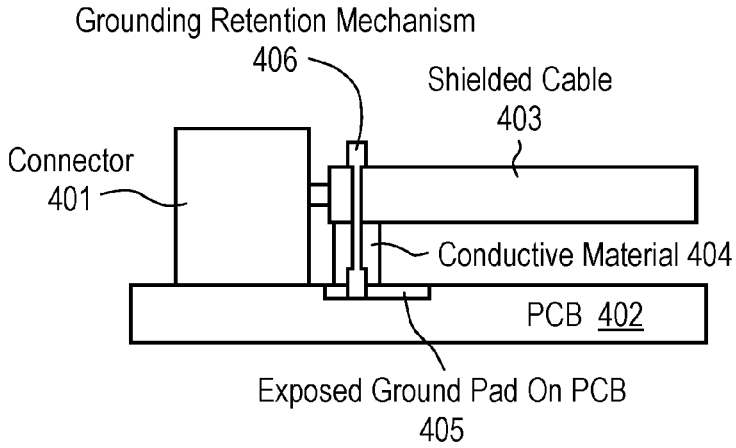
FIGS. 4A-4C illustrate an example of one embodiment of a lever-type retention mechanism.
Figure 4A:
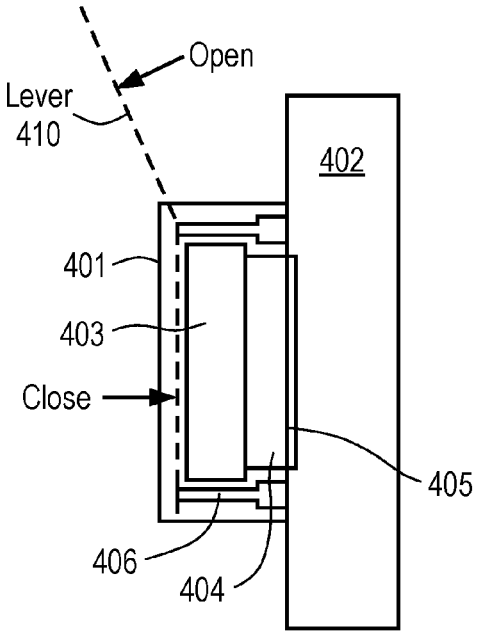
Figure 4C:
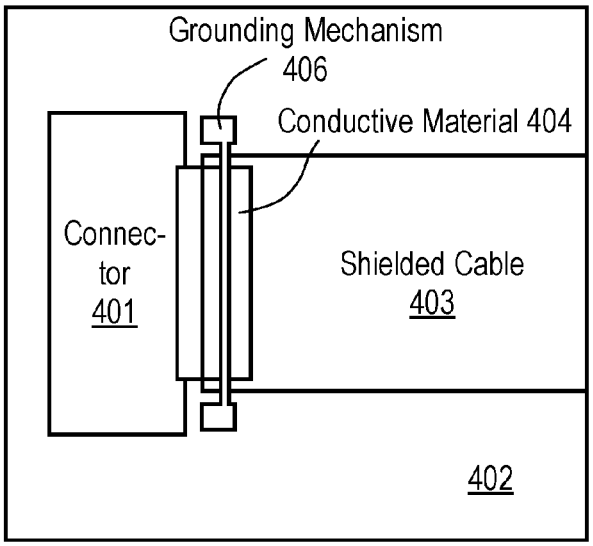

FIGS. 4A-4C illustrate an example of one embodiment of a lever-type retention mechanism. FIG. 4A illustrates a front view of one embodiment of the retention mechanism. Referring to FIG. 4A, a connector 401 is attached to a PCB 402. Electrically conductive material 404 is coupled to ground pad 405 on PCB 402. Also coupled to conductive material 404 is shielded cable 403 when shielded cable 403 is electrically connected to connector 401. A grounding retention mechanism 406 is coupled to PCB 402 and includes lever 410. Lever 410 is shown in an open and closed positions. When lever 410 is in a closed position, a force is applied to shielded cable 403 to make electrical contact via conductive material 404 to ground pad 405.

FIG. 4B illustrates a side view of the grounding retention mechanism 406, and FIG. 4C illustrates a top view of the grounding retention mechanism 406.

Figure 5:
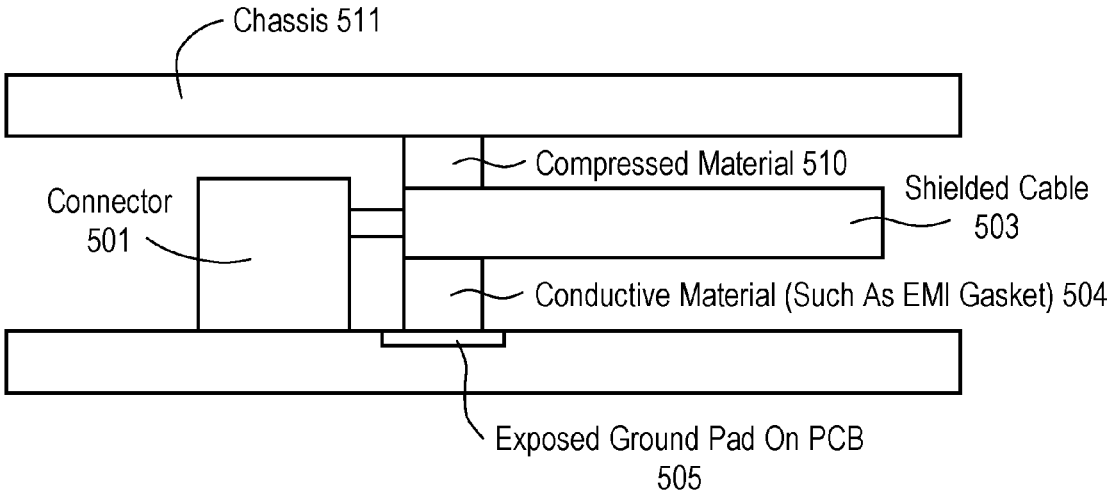
FIG. 5 illustrates one embodiment of an integrated grounding retention mechanism.

In one embodiment, the grounding retention mechanism comprises a compressible material and an actuator. In one embodiment, the compressible material is coupled to the shielded cable on the opposite side of where an electrically conductive material contacts the cable shield. In other words, the compressible material is aligned with the cable shield and the electrically conductive material. The actuator makes contact with the top of the compressible material to cause the compressible material to become compressed when the actuator is positioned on top of the compressible material. The material being compressed causes a force to be applied to the cable shield, which in turn makes an electrical connection between the shielded material and a ground of the substrate (e.g., a PCB). FIG. 5 illustrates one embodiment of an integrated grounding retention mechanism. Referring to FIG. 5, the connector 501 is attached to PCB 502. PCB 502 includes an exposed ground pad 505. A conductive material (e.g., an EMI gasket) 504 is electrically connected to ground pad 505. Shielded cable 503 is electrically connected to connector 501. Compressed material 510 is on top of shielded cable 503 and is attached to chassis 511.

Chassis, or another type of actuator, 511 is positioned to make contact with compressed material 510, causing compressed material 510 to become compressed. In one embodiment, this occurs when the chassis is installed. When compressed material 510 is compressed, a force is applied to shielded cable 503 which causes an electrical connection between shielded cable 503 and ground pad 505 via conductive material 504. Thus, the compressed material applies a force to the cable shield and achieves the required grounding for low RFI.

Figure 6:
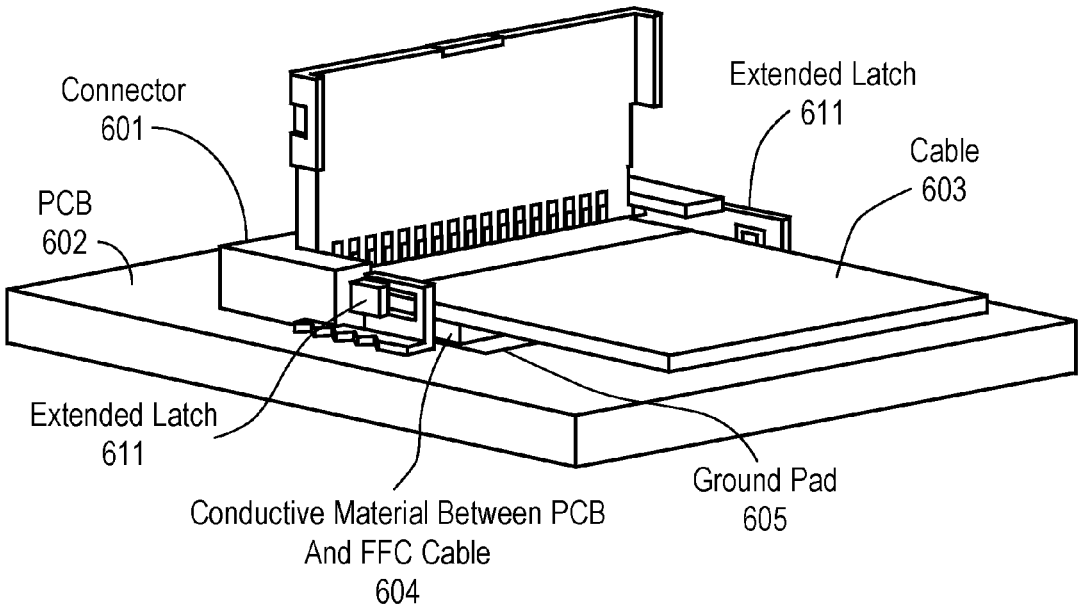
FIG. 6 illustrates an example of an extended latch for mechanical retention.

In one embodiment, the grounding retention mechanism includes an extended latch for mechanical retention of the cable. In one embodiment, the latch engages one or more sides of the shield of the cable to secure the cable when an end of the cable is electrically connected with the connector. FIG. 6 illustrates an example of an extended latch for mechanical retention.

Referring to FIG. 6, a connector 601 is coupled to PCB 602. An end of cable 603 is electrically connected to connector 601. A conductive material 604 is between a ground pad on PCB 602 and cable 603. Extended latch 611 extends on both sides of cable 603. In one embodiment, extended latch 611 includes a hole that secures an extension that protrudes off the sides of cable 603. When cable 603 is connected to connector 601, the extensions protruding from cable 603 extend into the hole of the extended latch 611 and are secured.

Figure 7:
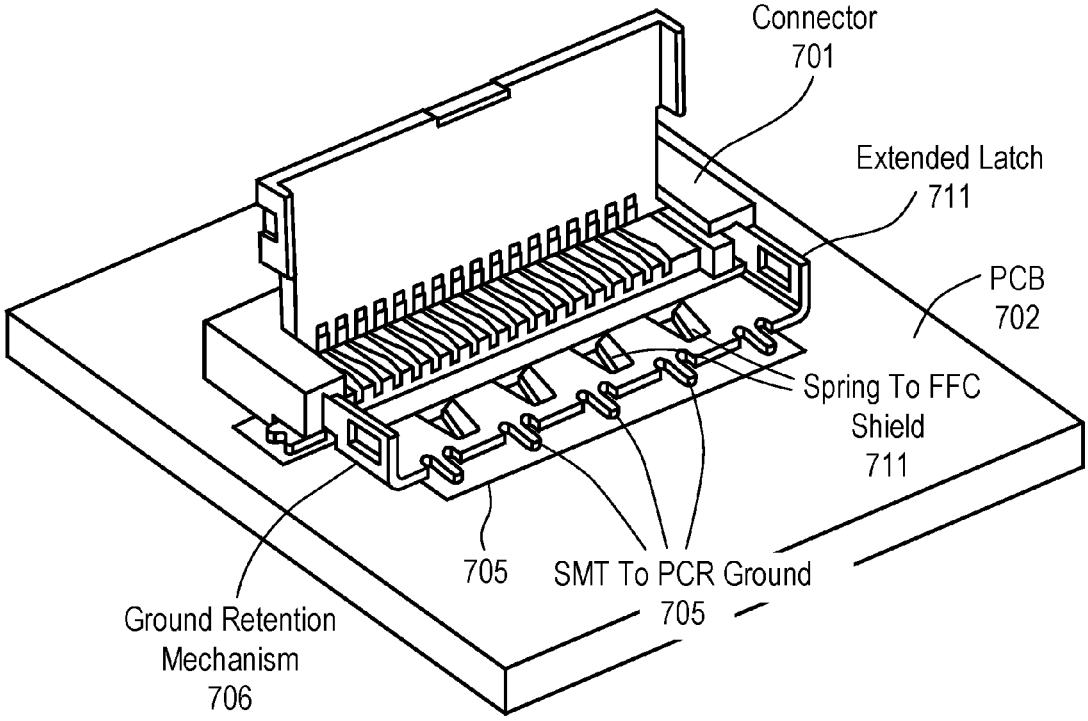
FIG. 7 illustrates one embodiment of an example of a conductive material having spring regions.

In another embodiment, grounding retention mechanism includes a conductive material that is integrated into a connector with spring areas that electrically connect with a cable when the cable is connected with the connector. In this case, the grounding retention mechanism comprise the one or more spring regions. FIG. 7 illustrates one embodiment of an example of a conductive material having spring regions.

Referring to FIG. 7, a PCB 702 includes a connector 701 attached thereto. PCB 702 includes ground pad 705 (a voltage reference node). Electrically connected to ground pad 705 is grounding retention mechanism 706 which includes springs 711. In one embodiment, the grounding retention mechanism 706 is electrically connected to ground 705 via surface mount technology; however, other connection schemes may be used. When a shielded cable (e.g., FFC/PFC cable) is electrically connected to connector 701, springs 711 (which extend upward) make electrical contact with the conductive shield on cable, thereby causing the cable to be electrically connected to ground 705 and grounding the cable.

Figure 8:
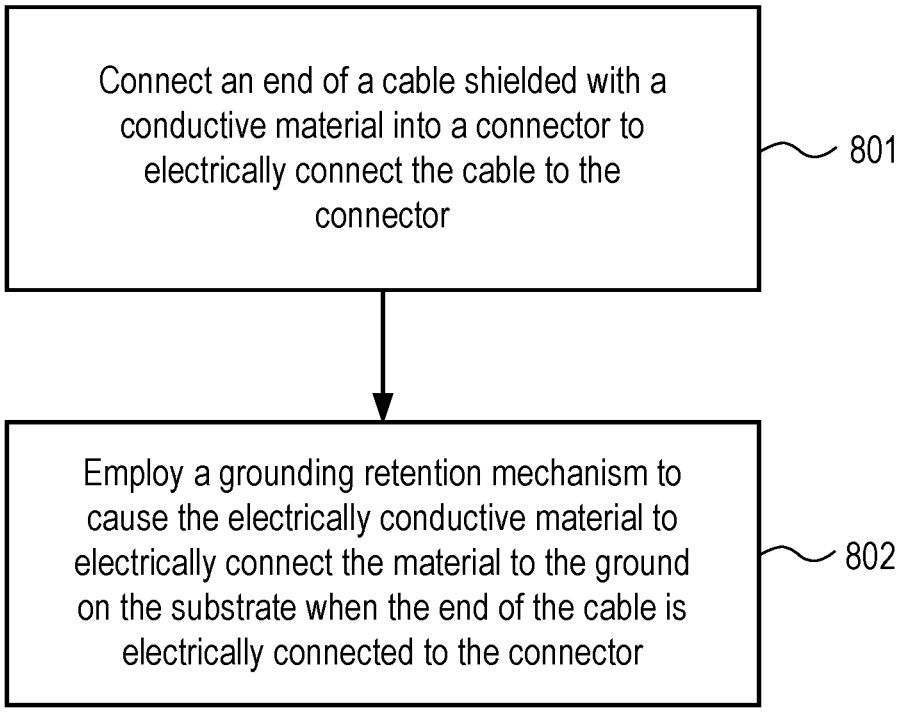
FIG. 8 is a flow diagram of a process for using a grounding retention mechanism to ground a cable connected to a connector.

FIG. 8 is a flow diagram of a process for using a grounding retention mechanism to ground a cable connected to a connector. Referring to FIG. 8, the process begins by electrically connecting an end of a cable (shielded with a conductive material) with a connector (processing block 801). In one embodiment, the connector is coupled to a substrate having a ground and an electrically conductive material is coupled to the ground of the substrate (e.g., an exposed ground pad).

Next, the processing logic employs a grounding retention mechanism to cause the electrically conductive material to electrically connect the material to the substrate ground when the end of the cable is electrically connected to the connector by applying a force to the cable shield (processing block 802). In one embodiment, employing the grounding mechanism includes moving at least a portion of the grounding retention mechanism to apply a retention force on the shield of the cable after the cable has been electrically connected to the connector. In one embodiment, the electrically conductive material is compressible and the retention force causes compression of the electrically conductive material between the cable and the substrate ground when the force is applied to the shield.

Unlike conductive tapes where the connection will degrade over time due to deterioration of the boding material, the techniques described herein provide a reliable connection between a cable shield and a substrate (e.g., PCB) ground for superior EMI/RFI reduction.

Furthermore, if replacement of an internal cable is needed, the techniques described herein provide an easy way to remove/uninstall the cable without damaging the connector. This resolves potential customer issues of destructive reworking and saves the cost of replacing damaged connector.

In a first example embodiment, an apparatus comprises a substrate having a first node, a connector coupled to the substrate, a cable shielded with a conductive material and having an end connectable to the connector to electrically connect with the connector, an electrically conductive material coupled to the first node of the substrate, and a retention mechanism (e.g., a grounding retention mechanism) to cause the electrically conductive material to electrically connect the cable to the first node of the substrate by applying a force to the cable shield.

In another example embodiment, the subject matter of the first example embodiment can optionally include that the retention mechanism comprises a retention actuator coupled to the connector to apply a retention force on the shield of the cable when in a first position after the cable has been electrically connected to the connector, where the electrically conductive material is compressible and the force causes compression of the electrically conductive material between the cable and the first node of the substrate when applied on the shield.

In another example embodiment, the subject matter of the first example embodiment can optionally include that the electrically conductive material is integrated into the connector and the retention mechanism comprises one or more spring regions included in the electrically conductive material.

In another example embodiment, the subject matter of the first example embodiment can optionally include a latch to engage with one or more sides of the shield of the cable to secure the cable when an end of the cable is electrically connected to the connector.

In another example embodiment, the subject matter of the first example embodiment can optionally include that the retention mechanism comprises a screw-type actuator with a screw hole.

In another example embodiment, the subject matter of the first example embodiment can optionally include that the grounding retention mechanism comprises a latch-type actuator that latches to the substrate when in a first position.

In another example embodiment, the subject matter of the first example embodiment can optionally include that the latch-type actuator comprises a fork, a hook or an eye-of-needle (EON) as part of a latch coupled to the connector.

In another example embodiment, the subject matter of the first example embodiment can optionally include that the substrate comprises a plated-through hole (PTH) via and the lever latches to the PTH via in the substrate.

In another example embodiment, the subject matter of the first example embodiment can optionally include that the retention mechanism comprises a lever-type retention mechanism.

In another example embodiment, the subject matter of the first example embodiment can optionally include that the retention mechanism comprises a compressible material coupled to the shielded cable on a side of the cable opposite where the electrically conductive material contacts the cable shield and an actuator to cause the compressible material to become compressed when the actuator is positioned on top of the compressible material, where the material is compressed causing a force to be applied to the cable shield.

In another example embodiment, the subject matter of the first example embodiment can optionally include that the first node comprises an exposed ground pad, and the retention mechanism comprises a grounding retention mechanism.

In another example embodiment, the subject matter of the first example embodiment can optionally include that the electrically conductive material comprises an EMI gasket.

In a second example embodiment, an apparatus comprises a substrate having a reference node, a connector coupled to the substrate, an electrically conductive material coupled to the reference node of the substrate, and a retention mechanism to cause the electrically conductive material to electrically connect a cable shielded with a conductive material to the reference node of the substrate when an end of the cable is electrically connected to the connector by applying a force to the cable shield.

In another example embodiment, the subject matter of the second example embodiment can optionally include that the retention mechanism comprises a retention actuator coupled to the connector to apply a retention force on the shield of the cable when in a first position after the cable has been electrically connected to the connector, where the electrically conductive material is compressible and the force causes compression of the electrically conductive material between the cable and the reference node of the substrate when applied on the shield.

In another example embodiment, the subject matter of the second example embodiment can optionally include that the electrically conductive material is integrated into the connector and the retention mechanism comprises one or more spring regions included in the electrically conductive material.

In another example embodiment, the subject matter of the second example embodiment can optionally include a latch to engage with one or more sides of the shield of the cable to secure the cable when an end of the cable is electrically connected to the connector.

In another example embodiment, the subject matter of the second example embodiment can optionally include that the retention mechanism comprises a latch-type actuator that latches to the substrate when in a first position.

In another example embodiment, the subject matter of the second example embodiment can optionally include that the retention mechanism comprises a compressible material coupled to the shielded cable on a side of the cable opposite where the electrically conductive material contacts the cable shield, and an actuator coupled to the top of the compressible material to cause the compressible material to become compressed when the actuator is positioned on top of the compressible material, where the material is compressed causing a force to be applied to the cable shield.

In another example embodiment, the subject matter of the second example embodiment can optionally include that the reference node comprises an exposed ground pad.

In another example embodiment, the subject matter of the second example embodiment can optionally include that the electrically conductive material comprises an EMI gasket.

In a third example embodiment, a method comprises: connecting an end of a cable shielded with a conductive material into a connector to electrically connected the cable to the connector, the connector coupled to a substrate having a first node, and wherein an electrically conductive material is coupled to the first node of the substrate; and employing a retention mechanism to cause the electrically conductive material to electrically contact the cable to the first node of the substrate when the end of the cable electrically connected to the connector by applying a force to conductive material of the cable shield.

In another example embodiment, the subject matter of the third example embodiment can optionally include that employing a retention mechanism comprises moving a retention actuator to apply a retention force on the shield of the cable after the cable has been electrically connected to the connector, the electrically conductive material being compressible, the retention force causing compression of the electrically conductive material between the cable and the first node of the substrate when the force is applied on the shield.

In another example embodiment, the subject matter of the third example embodiment can optionally include that the retention mechanism comprises a screw-type, latch-type or lever-type actuator, and wherein employing a retention mechanism comprises moving the actuator to maintain contact between the cable and the first node of the substrate when the actuator contacts the shield.

In another example embodiment, the subject matter of the third example embodiment can optionally include that the first node comprises an exposed ground pad.

In another example embodiment, the subject matter of the third example embodiment can optionally include that the electrically conductive material comprises an EMI gasket.

Some portions of the detailed descriptions described above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. An apparatus comprising:
a substrate having a first node;
a connector coupled to the substrate;
a cable shielded with a first conductive material and having an end connectable to the connector to electrically connect with the connector;
an electrically conductive material coupled to the first node of the substrate and located between the cable and the substrate; and
a retention mechanism to cause the electrically conductive material to electrically connect the first conductive material shielding the cable to the first node of the substrate by applying a force to at least a portion of the first conductive material shielding the cable to cause the first conductive material to contact the electrically conductive material, and
wherein the electrically conductive material is integrated into the connector and the retention mechanism comprises one or more spring regions included in the electrically conductive material.

2. The apparatus defined in claim 1 further comprising a latch to engage with one or more sides of the first conductive material of the cable to secure the cable when an end of the cable is electrically connected to the connector.

3. The apparatus defined in claim 1 wherein the first node comprises an exposed ground pad.

4. The apparatus defined in claim 1 wherein the electrically conductive material comprises an EMI gasket.

5. An apparatus comprising:
a substrate having a first node;
a connector coupled to the substrate;
a cable shielded with a first conductive material and having an end connectable to the connector to electrically connect with the connector;
an electrically conductive material coupled to the first node of the substrate and located between the cable and the substrate; and
a retention mechanism to cause the electrically conductive material to electrically connect the first conductive material shielding the cable to the first node of the substrate by applying a force to at least a portion of the first conductive material shielding the cable to cause the first conductive material to contact the electrically conductive material, wherein the retention mechanism comprises a retention actuator coupled to the connector to apply a retention force on the first conductive material of the cable when in a first position after the cable has been electrically connected to the connector, the electrically conductive material being compressible, the force to cause compression of the electrically conductive material between the cable and first node of the substrate when applied on the first conductive material.

6. An apparatus comprising:
a substrate having a first node;
a connector coupled to the substrate;
a cable shielded with a first conductive material and having an end connectable to the connector to electrically connect with the connector;
an electrically conductive material coupled to the first node of the substrate; and
a retention mechanism to cause the electrically conductive material to electrically connect the first conductive material shielding the cable to the first node of the substrate by applying a force to at least a portion of the first conductive material shielding the cable, wherein the retention mechanism comprises a latch-type actuator that latches to the substrate when in a first position and further wherein the substrate comprises a plated-through hole (PTH) via and the lever latches to the PTH via in the substrate.

7. The apparatus defined in claim 6 wherein the latch-type actuator comprises a fork, a hook or an eye-of-needle (EON) as part of a latch coupled to the connector.

8. An apparatus comprising:
a substrate having a first node;
a connector coupled to the substrate;
a cable shielded with a first conductive material and having an end connectable to the connector to electrically connect with the connector;
an electrically conductive material coupled to the first node of the substrate; and
a retention mechanism to cause the electrically conductive material to electrically connect the first conductive material shielding the cable to the first node of the substrate by applying a force to at least a portion of the first conductive material shielding the cable, wherein the retention mechanism comprises:
a compressible material coupled to the cable on a side of the cable opposite where the electrically conductive material contacts the first conductive material of the cable; and
an actuator to cause the compressible material to become compressed when the actuator is positioned on top of the compressible material, the compressible material being compressed causing a force to be applied to the first conductive material of the cable.

9. An apparatus comprising:
a substrate having a reference node;
a connector coupled to the substrate;
an electrically conductive material coupled to the reference node of the substrate; and
a retention mechanism to cause the electrically conductive material to electrically connect a cable shielded with a first conductive material to the reference node of the substrate when an end of the cable is electrically connected to the connector by applying a force to the first conductive material of the cable and cause the first conductive material to contact the electrically conductive material, the electrically conductive material being located between the cable and the substrate, wherein the electrically conductive material is integrated into the connector and the retention mechanism comprises one or more spring regions included in the electrically conductive material.

10. The apparatus defined in claim 9 further comprising a latch to engage with one or more sides of the first conductive material of the cable to secure the cable when an end of the cable is electrically connected to the connector.

11. The apparatus defined in claim 9 wherein the reference node comprises an exposed ground pad.

12. The apparatus defined in claim 9 wherein the electrically conductive material comprises an EMI gasket.

13. An apparatus comprising:
a substrate having a reference node;
a connector coupled to the substrate;
an electrically conductive material coupled to the reference node of the substrate; and
a retention mechanism to cause the electrically conductive material to electrically connect a cable shielded with a first conductive material to the reference node of the substrate when an end of the cable is electrically connected to the connector by applying a force to the first conductive material of the cable and cause the first conductive material to contact the electrically conductive material, the electrically conductive material being located between the cable and the substrate, wherein the retention mechanism comprises a retention actuator coupled to the connector to apply a retention force on the first conductive material of the cable when in a first position after the cable has been electrically connected to the connector, the electrically conductive material being compressible, and the force to cause compression of the electrically conductive material between the cable and the reference node of the substrate when applied on the first conductive material.

14. An apparatus comprising:

a substrate having a reference node;

a connector coupled to the substrate;

an electrically conductive material coupled to the reference node of the substrate; and a retention mechanism to cause the electrically conductive material to electrically connect a cable shielded with a first conductive material to the reference node of the substrate when an end of the cable is electrically connected to the connector by applying a force to the first conductive material of the cable, wherein the retention mechanism comprises:

a compressible material coupled to the cable on a side of the cable opposite where the electrically conductive material contacts the first conductive material of the cable; and an actuator coupled to the top of the compressible material to cause the compressible material to become compressed when the actuator is positioned on top of the compressible material, the material being compressed causing a force to be applied to the first conductive material of the cable.

15. A method comprising:

connecting an end of a cable shielded with a first conductive material into a connector to electrically connected the cable to the connector, the connector coupled to a substrate having a first node, and wherein an electrically conductive material is coupled to the first node of the substrate; and employing a retention mechanism to cause the electrically conductive material to contact the first conductive material of the cable to electrically connect the first conductive material of the cable to the first node of the substrate when the end of the cable electrically connected to the connector by applying a force to the first conductive material of the cable, wherein employing a retention mechanism comprises moving a retention actuator to apply a retention force on the first conductive material of the cable after the cable has been electrically connected to the connector, the electrically conductive material being compressible, and the retention force causing compression of the electrically conductive material between the cable and the first node of the substrate when the force is applied on the first conductive material.

16. The method defined in claim 15 wherein the first node comprises an exposed ground pad.

17. The method defined in claim 15 wherein the electrically conductive material comprises an EMI gasket.

* * * * *